United States Patent [19]

Hutter

[11] 3,936,125

[45] Feb. 3, 1976

[54] ELECTRICAL CONNECTOR WITH METAL TO METAL SEAL

[75] Inventor: Harold Gregory Hutter, Brookfield, Conn.

[73] Assignee: Bunker Ramo Corporation, Oak Brook, Ill.

[22] Filed: Jan. 28, 1974

[21] Appl. No.: 437,277

[52] U.S. Cl. ..... 339/94 C; 333/97 R; 339/95 A; 339/177 E

[51] Int. Cl.[2] ..... H01R 7/02

[58] Field of Search ..... 285/DIG. 18; 333/97 R; 339/94 R, 94 A, 94 C, 94 M, 95 R, 95 A, 177 R, 177 E, 177 L

[56] References Cited

UNITED STATES PATENTS

| | | | |
|---|---|---|---|
| 2,413,308 | 12/1946 | Arnold | 285/DIG. 18 |
| 3,406,373 | 10/1968 | Forney | 339/177 R |
| 3,673,546 | 6/1972 | Green | 339/177 R |

FOREIGN PATENTS OR APPLICATIONS

| | | | |
|---|---|---|---|
| 1,085,339 | 1/1955 | France | 285/DIG. 18 |

*Primary Examiner*—Roy Lake
*Assistant Examiner*—Mark S. Bicks
*Attorney, Agent, or Firm*—William Lohff; F. M. Arbuckle

[57] ABSTRACT

An electrical connector is provided in which one of the connecting members includes a mating section with a radial face of relatively soft metal disposed around an entry aperture and protected by a shroud member extending axially towards the other member to form an enlarged opening and internally having rotational coupling surfaces such as screw threads for coupling the members, the other other connecting member including a sleeve of harder metal housing at least one insulated contact hermetically mounted in a glass insert with the contact arranged to extend into the aperture of the one connecting member and an integral mating portion facing the second member with a radial flange formed by a circumferential undercut to be outwardly deflectable away from the radial face, the radial flange outwardly forming a deflectable beam section with radially inner and outer frontwardly converging surfaces and an axially extending cutting edge formed thereby, the sleeve outwardly including rotational coupling surfaces such as screw threads for rotational insertion into the shroud member aligning the cutting edge with the radial face while forcing the edge into the face in sealing penetration, the end of the sleeve opposite the cutting edge being adapted for connection to a conventional connector. In one embodiment, the radially inner surface is at an acute angle of about 30° and is longer than the outer surface to form an inner area of pressure engagement when the beam section is deflected. In a second embodiment, the cutting edge and adjoining surfaces are on a second deflectable beam section formed by a groove in the first beam section to provide multiple deflecting members.

17 Claims, 4 Drawing Figures

ELECTRICAL CONNECTOR WITH METAL TO METAL SEAL

BACKGROUND

This invention relates to electrical coaxial connectors and more particularly to connectors in which one of the connecting members includes a metallic sealing member as part of the connector housing and with a circular cutting edge on a deflectable beam section rigidly fastened to the housing.

Coaxial connectors with contacts heremetically sealed internally in an outer housing frequently require a releasable, external seal effective under changing conditions of temperature, humidity and the like. In some instances, one of the connector housings may include electronic components sensitive to changes in environmental conditions, and it is important that the seal provide protection against such changes while being releasable.

In one type of metal to metal seals for coaxial connectors, a separate sealing ring of relatively hard metal with a pair of opposed cutting surfaces is positioned between the connecting members which when coupled force the cutting surfaces to penetrate adjoining portions of softer metal and form the releasable seal. Usually, the members can be reconnected with the same ring and an effective seal re-established.

While the individual sealing ring usually provides an effective seal, there can be some problems associated with its use. Improper alignment or support of the ring with respect to one or both adjoining surfaces of softer metal can cause portions of one or both cutting surfaces to penetrate the softer surface before other portions, causing an adverse effect on the effectiveness of one or both seals. Also, two separate seals are required for one interconnection and it is important that both adjoining surfaces be free from environmental contaminents which would interfere with the efectiveness of the two-part seal. In addition, these connecting members can be of small size in the order of one-fourth of an inch in outside diameter and the rings of similar or smaller size can become mislaid or lost. Accordingly, connecting members of improved design are desirable.

SUMMARY

This invention is directed to an electrical connector with first and second connecting members in which one of the members includes a radial face of relatively soft metal and the other member includes a housing and a metal-cutting sealing member rigidly fixed on the housing for sealing penetration of the radial face to form a metal to metal seal. Advantageously, the radial face surrounds a contact receiving aperture and is recessed in a housing or protected by a shroud member which is further provided with internal coupling surfaces to couple the connecting members and for maintaining the metal-cutting sealing member is an aligned position with respect to the radial face during the coupling and sealing operation. The metal-cutting sealing member advantageously forms an integral part of an outwardly deflectable beam section inwardly rigidly fixed on a front section of the housing. Preferably, the sealing member and beam section are integrally formed as parts of a metallic housing of one-piece construction which outwardly includes with coupling surfaces for cooperation with the coupling surfaces on the shroud member.

The invention is also directed to a sealing member as an integral part of an outwardly deflectable beam section in which the sealing member includes radially inner and outer frontwardly converging surfaces and an axially extending cutting edge formed by those surfaces with a hardness greater than that of the radial face of the mating connecting member. The edge forms a peripheral enclosure of an internal portion of the housing and is disposed outwardly beyond the rigid inner end of the beam section. The sealing member is further formed with the inner converging surface at an acute angle with respect to the radial face of less than about 45° and rectilinearly longer than the outer converging surface. The outer converging surface is advantageously at an acute angle greater than that for the inner surface. The resultant sealing member can readily cut into the radial face of the mating connecting member with the outward deflection of the beam section causing the more closely associated inner surface to form an area of pressure engagement at reduced angle.

One of the advantages of the electrical connector of the invention is that the sealing member is in alignment with its associated connecting member during the sealing operation. Another advantage is that only one metal to metal seal is required for an interconnection. A further advantage is that the sealing member is rigidly fixed on a connecting member and therefore is less subject to becoming mislaid or lost. An additional advantage is that the cooperating radial face can be recessed or protected by a shroud member which advantageously has coupling surfaces for aligning the sealing members. Yet another advantage is that the area of pressure engagement is formed by an inner surface inclined at a small angle with respect to adjacent radial face and which cooperates with an outwardly deflectable beam section to provide a sealing action with a limited number of connector parts.

DETAILED DESCRIPTION

The electrical connector of the invention comprises first and second connection members in which a first member includes a housing with an aperture, a mating section of metallic construction having a radial face peripherally extending about the aperture, and a shroud member axially extending from the face towards the second member and generally parallel to the aperture to define an enlarged opening. The second member includes a sleeve usually of metallic construction and having an interior and a mating portion facing the first member, and contact means disposed in the interior and arranged to extend into the enlarged opening. Coupling means are provided for moving the mating portion of the second member axially within the shroud member in an aligned position to penetrate the radial face. To provide a sealing member cooperating with the radial face, the mating portion includes a front section of reduced outer diameter and a radial flange having an inner end rigidly fixed on the front section and at least one deflectable integral beam section extending outwardly therefrom for engagement with the radial face. The beam section has a portion of metallic construction facing the radial surface with radially inner and outer frontwardly converging surfaces and an axially extending cutting edge formed thereby with a hardness greater than that of the metallic section for sealing penetration of the radial surface. The edge is disposed outwardly beyond the inner end and peripherally about the interior of the sleeve. Engagement of the cutting edge of the radial face deflects the beam section outwardly moving the inner converging surface to a smaller angle with respect to the radial face to form an area of pressure engagement.

Figure 1:
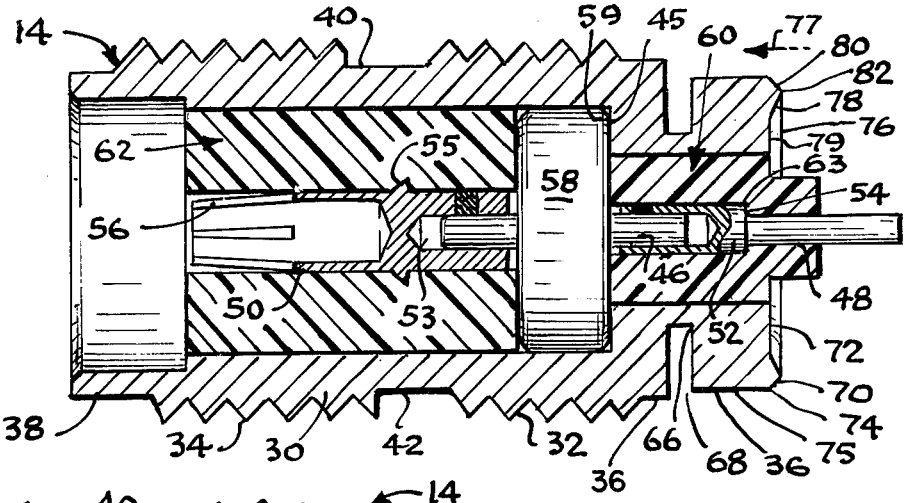
FIG. 1 is a side view in cross section of an electrical connecting member of the invention.

In one embodiment, the seal member is provided on an electrical connecting member which comprises contact means, insulating means for receiving the contact means, and housing means for the contact means and insulating means including a metal sleeve. Means are provided for axially coupling the sleeve to a mating member and sealing penetration with a radial face on the mating member. The sealing member includes radially inner and outer converging surfaces and an axially extending cutting edge formed by the surfaces with a hardness greater than that of the radial surface for sealing penetration of that surface. To provide an effective area of pressure engagement, the inner converging surface is formed at an acute angle less than about 45° with respect to the radial surface and during the sealing penetration moves to a position reducing the angular separation. Advantageously, the outer converging surface is at a second acute angle greater than that of the angle formed by the inner surface. Preferably, the inner converging surface is rectilinearly longer than the outer converging surface. The relationship of the various features may be understood upon reference to FIGS. 1 – 4. The electrical connector of one embodiment includes a connecting member 12 illustrated in FIG. 3 and a second connecting member 14 illustrated in FIGS. 1 – 3 which when coupled, form a metal to metal seal. Connecting member 12 includes a housing 16 with a connecting end 17 representing means for interconnection to an electrical or electronic receptacle. Housing 16 is commonly formed of aluminum with a recessed aperture 18 providing access for electrical interconnection beyond connecting end 17 and is enclosed by a radially inwardly extending shoulder having a radial face 20 and through which the passageway or aperture 18 extends and an internally threaded sleeve or mating section 22. Radial face 20 is environmentally protected by shroud member 24 extending towards member 14 and is internally provided with screw threads 25 to serve as a coupling means for receiving a rotatable coupling member 14 into enlarged opening 26 aligned with aperture 18 along axis 28. As illustrated, screw threads 25 do not extend to the radial face 20 to prevent excessive forces being applied to the sealing mechanism and to provide space for outward deflection of the beam section of member 14. As illustrated in FIG. 3, shroud member 24 is formed as an integral part of housing 16 and extends outwardly from the radial face to provide both coupling means and protection to radial face 20 against deposition of contaminants.

The second connecting member 14 is illustrated as a connecting adapter having an outer sleeve 30 with screw threads 32 and 34 at opposite ends 36 and 38 for respective coupling to member 12 and to a standard connector. In one embodiment, the sealing member is integrally formed as part of the sleeve 30 with the material of construction being a relatively hard metal such as stainless steel or the like. Means for rotating the sleeve 30 is provided by a pair of flat surfaces 40 and 42 upon which a wrench or other suitable tool can be fastened for rotatably coupling the sleeve 30 to shroud member 24.

The interior 44 of sleeve 30 includes contacts 46, 48 and 50 and insulating inserts 58, 60 and 62 for insulating the contacts from the sleeve 30. As illustrated, contact 46 is formed as a pin member commonly composed of a iron-nickel alloy fused in glass insert 58 plated with copper and mated with contacts 48 and 50 suitably composed of beryllium copper. Contact 48 is provided with shoulder 54 for positioning within insert 60 while contact 50 is provided with mounting barbs 55 for a similar purpose and mating tines 56 for mating engagement with a mating connector. Glass insert 58 has an outer rim 59 sealed to sleeve 30 by firing or a similar procedure. Opposite inserts 60 and 62 are commonly formed of a plastic which advantageously is a fluorocarbon polymer such as polytetrafluoroethylene. Insert shoulder 63 forms an abutment for securing contact 48 in a desired position.

Sleeve 30 is provided with a mating portion and external threads for mating engagement with connecting member 12 and which is shaped with the front section having a stem 66 of reduced diameter formed by an undercut 68. Radial flange 70 is integrally formed on the front section and extends radially outwardly from the stem to form a radial face or end 72 having a deflectable beam section 74 at outer end 75. As illustrated, beam section 74 is sized smaller than shroud member 24 and is spaced axially from the sleeve portion 30 by stem 66 to permit room for outward or axially rearward deflection of the beam section. Portion 76 of metallic construction is provided on beam section 74 with radially inner and outer axially and radially extending diverging surfaces 78 and 80 forming an axially forwardly extending annular tooth or cutting edge 82 for penetrating engagement with radial face 20. Edge 82 is outwardly spaced from the outer diameter of stem 66 so that engagement between edge 82 and radial face 20 causes beam section 74 to deflect or flex in a direction 77 away from face 20 causing inner surface 78 to reduce the angular separation from face 20 with the spring bias introduced by the flexure of flange 70 being applied between the end radial face of flange 70 and face 20 to assist in sealing aperture of passageway 18. To provide a seal completely round interior 44 or between passageway 18 and the enlarged opening 26, surfaces 78 and 80 and edge 82 extend around the front periphery of sleeve 30. The hardness of edge 82, may result from the hardness of sleeve 30 but edge 82 can also be hardened by conventional hardening processes after the edge has been machined.

Figure 2:
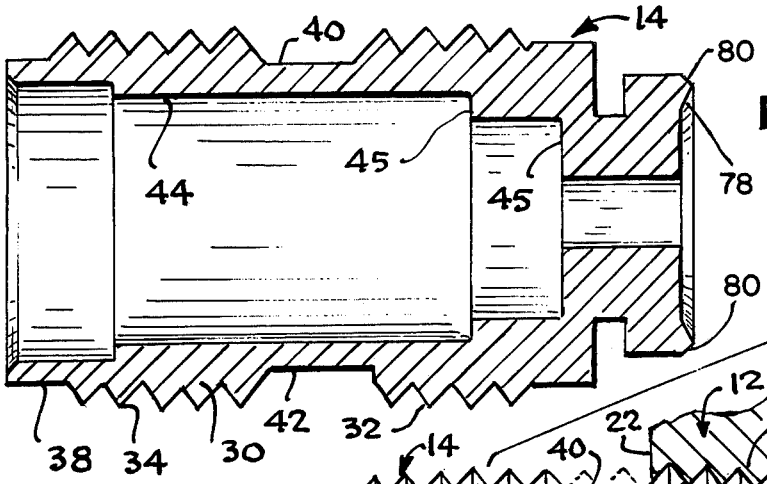
FIG. 2 is a similar view of FIG. 1 without the internal parts of the connecting member.
Figure 3:
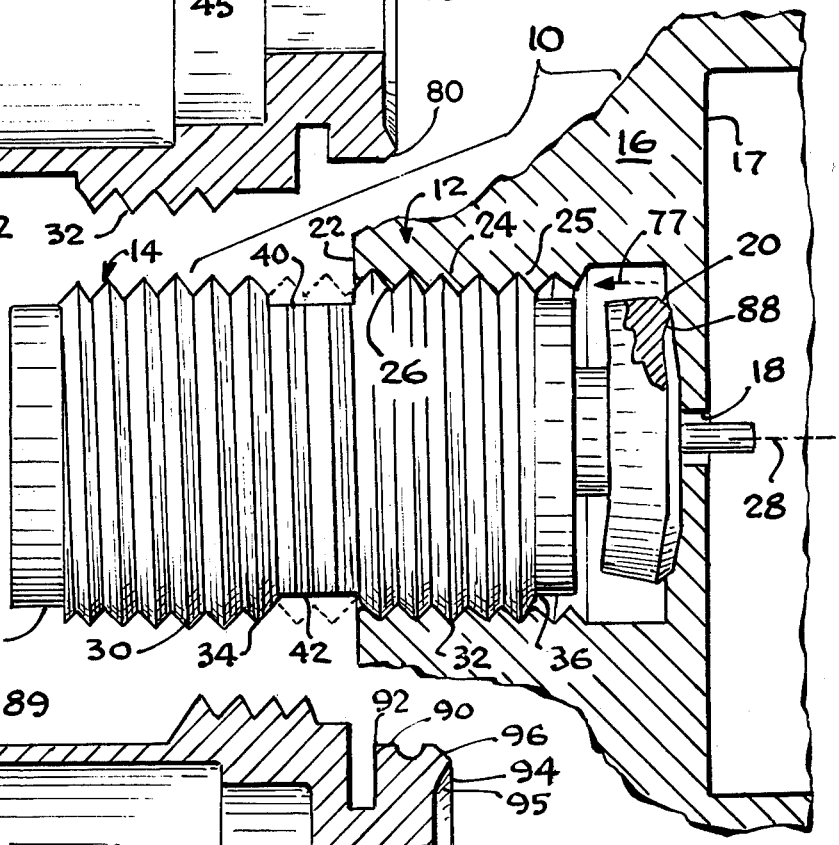
FIG. 3 is a side view partially in cross section illustrating a connecting member of FIG. 1 coupled to a mating connector member.

In FIG. 2, the taper of surface 78 is illustrated at an acute angle of less than about 45° to the plane of radial face 72, more usually about 20°–40° and preferably about 30°. At such angles, surface 78 during penetration of radial face 20 provides an area of pressure engagement with a substantial component of force parallel to the axis 28. As further illustrated, length 79 of surface 78 is rectilinearly longer or has a radial area greater than outer surface 80 which is usually formed at an acute angle to the radial plane of face 72 greater than the angle formed by inner surface 78. The second acute angle formed by outer surface 80 is illustrated at an angle of about 45°.

Figure 4:
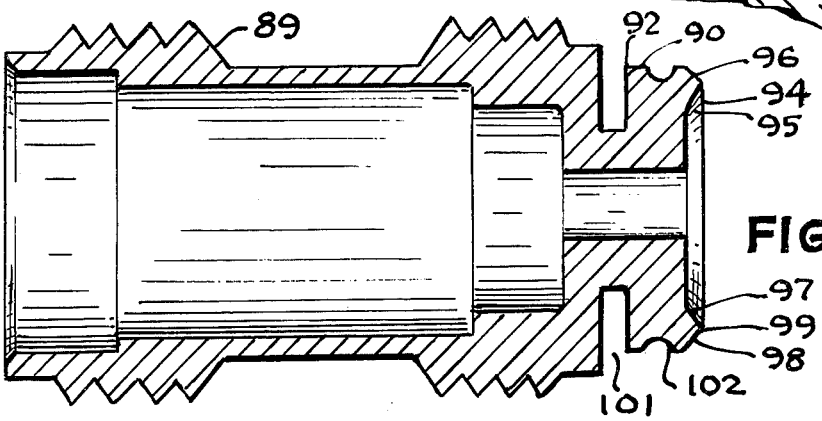
FIG. 4 is a second embodiment of the connecting member of the invention.

In FIG. 4, a second embodiment is illustrated with the first and second deflecting beam sections 90 and 94. Beam section 94 is formed on a flange 92 having an end radial face on which an annular axially projecting tooth 95 defining an end edge 99 is formed by axial and radially extending surfaces 97 and 98. The flange 92 is fixed to the sleeve by means of an annular reduced diameter stem. The outer end 96 of the flange is inclined frontwardly and includes surfaces 97 and 98 and cutting edge 99 as described with respect to surfaces 78 and 80 and edge 82. Undercut or groove 101 and groove 102 spaced axially forwardly of groove 101 form and permit deflection of both beam sections.

Following assembly of connecting member 14 in which glass insert 58 is positioned against shoulder 45, connecting member 14 is rotated in shroud member 24 which axially aligns members 12 and 14 and cutting edge 82 and radial face 20. Further rotation of member 14 moves cutting edge 82 to engage radial face 20 and to penetrate the face to form the desired metal to metal seal. During penetration, beam section 74 is outwardly deflected causing inner surface 78 to move to an angular position closer to surface 20.

The construction of connecting member 14 provides in a unitary one piece construction, sleeve 30 with deflectable beam section 74 and a metal cutting sealing member as an integral part of the sleeve. Further, the sealing member is formed so that cutting edge 82 is moved slightly outwardly as radial face 20 is penetrated causing inner surface 78 to provide an effective area of pressure engagement for the desired seal. In addition, shroud 24 in combination with elongated sleeve 30 and screw threads 25 and 32 protect the sealing members against accidental angular deflection and damage to the seal.

I claim:

1. An electrical connector comprising:

first and second connecting members;

the first member including a housing with an aperture, a mating section of metallic construction having a first radial face peripherally extending about the aperture, and a shroud member axially extending from said first face towards the second member and generally parallel to the aperture to define an enlarged opening, the second member including a sleeve having an interior and a mating portion, and contact means carried by said sleeve and arranged to extend into said aperture in response to the receipt of said mating portion in said enlarged opening, and means for coupling said first and second members in conjunction with the movment of said mating portion axially within said shroud member, said mating portion including a front section of reduced outer diameter and a radial flange having an inner end rigidly fixed on the front section and at least one deflectable integral beam section extending outwardly therefrom for engagement with said first radial face, said one beam section having a portion of metallic construction facing said first radial face with radially inner and outer frontwardly converging surfaces and an axially extending cutting edge formed thereby with a hardness greater than that of said metallic section for sealing penetration of said first radial face in response to the coupling of said first and second members, said cutting edge being disposed outwardly beyond said inner end and peripherally about said aperture.

2. The electrical connector of claim 1 wherein said housing is of metallic construction and extends outwardly from said radial face to form said shroud member.

3. The electrical connector of claim 2 wherein said sleeve is of metallic construction and said means for coupling includes means for rotationally coupling the sleeve to the shroud member.

4. The electrical connector of claim 1 wherein said flange includes a first deflectable beam section with said inner end rigidly fixed on said front section and a second deflectable beam section with an end rigidly fixed on said first beam section, said second beam section including said converging surfaces and said cutting edge.

5. The electrical connector of claim 1 wherein said means includes rotational coupling means internally on the shroud member and externally on the sleeve whereby said sleeve moved rotationally and axially into said shroud member.

6. The electrical connector of claim 1 wherein said beam section is of reduced size compared to said enlarged opening and is capable of deflection without engaging said shroud member.

7. The electrical connector of claim 1 wherein said deflectable section is deflectable by engagement with said radial face in a direction away from said radial face, and said inner radial surface with said radial face forms an acute angle less than about 45° and an area of pressure engagement which is increased during penetration of said radial face.

8. An electrical connector comprising:

first and second connecting members;

the first member including a metallic housing with an aperture, a mating section integral with the housing having a first radial face peripherally extending about the aperture and facing said second member and a shroud member integral with the housing axially extending from the face towards the second member to define an enlarged opening, the second member including a metallic sleeve having an interior and a mating portion integral with the sleeve, contact means disposed in the interior and arranged to extend into the enlarged opening, and insulating means disposed between the sleeve and contact means, said mating portion including a front section of reduced outer diameter and a radial flange having an inner end rigidly fixed on the front section and a deflectable integral beam section extending outwardly therefrom for engagement with said first radial face, said beam section having a portion of metallic construction facing said first radial face with radially inner and outer frontwardly converging surfaces and an axially extending cutting edge formed thereby with a hardness greater than that of said metallic section for sealing penetration of said radial surface, said edge being disposed outwardly beyond said inner end and peripherally about said aperture for deflection away from said first radial face in response to the engagement of said cutting edge with said first radial face, and means for coupling said first and second members including cooperating rotational coupling means internally integral with the shroud member and externally integral with the sleeve whereby said sleeve is moved axially into the shroud to rotate the radial flange and axially extending cutting edge with respect to the first radial face and simultaneously engage said cutting edge with said first radial face.

9. The electrical connector of claim 8 wherein said inner radial surface with said radial face forms an acute angle less than about 45°.

10. The electrical connector of claim 9 wherein said inner converging surface is rectilinearly longer than said outer converging surface.

11. The electrical connector of claim 10 wherein said outer converging surface forms a second acute angle with said radial surface which is greater than the acute angle formed by said inner surface and said beam section is of reduced size compared to said enlarged opening.

12. An electrical connecting member for sealing penetration with a radial surface of a mating connecting member and comprising:

contact means, insulating means receiving said contact means, and housing means for said contact means and insulating means including a metal sleeve having a longitudinal axis and an interior portion, and means for axially coupling said sleeve to said mating member, said sleeve including a front reduced diameter section and a radial flange having an inner end rigidly fixed on the front section and a deflectable integral beam section extending radially outwardly therefrom for engagement with said radial surface in response to the axial coupling of said sleeve to said mating member and deflectable by said engagement in a direction away from said radial surface, said beam section having a portion of metallic construction facing said radial surface with radially inner and outer frontwardly converging surfaces and an axially extending cutting edge formed thereby with a hardness greater than that of said radial surface, said edge being disposed radially outwardly of said inner end, said inner frontwardly converging surface forming an acute angle less than about 45° to increase the area of pressure engagement between said inner frontwardly converging surface and said radial surface during the penetration of said radial surface.

13. The connector of claim 12 wherein said outer converging surface forms a second acute angle with said radial surface which is greater than the acute angle formed by said inner surface.

14. The electrical connector of claim 12 wherein said actue angle is between about 20°–40°.

15. The electrical connector of claim 12 wherein said inner converging surface is rectilinearly longer than said outer converging surface.

16. The electrical connector of claim 13 wherein said acute angle between said inner surface and radial surface is between about 20°–40° and said inner converging surface is rectilinearly longer than said outer surface.

17. For use with a metallic connector member having a first annular sleeve portion including a radially inwardly extending shoulder formed in said sleeve portion with a coaxial passageway therein for receiving a contact carried by a second sleeve member threadingly received in said first annular sleeve portion, the improvement comprising:

an annular stem projecting from said second sleeve member, an annular flange on said stem extending radially outwardly of said stem and spaced from said second sleeve member with said annular flange having a radial end face and said contact extending through said stem and flange past said radial end face for receipt in said passageway, and an axially projecting annular tooth of harder material than said shoulder formed on said radial end face with said tooth located radially outwardly of said stem for engagement with said shoulder in response to the threading receipt of said second sleeve member in said first annular sleeve portion to cut a complimentary surface in said shoulder with the portion of said flange extending radially outwardly of said tooth flexing axially toward said second sleeve member for applying a spring force between said flange and shoulder for sealing the periphery of said passageway from the periphery of said flange.

* * * * *